US006499898B1

(12) United States Patent
Garcia

(10) Patent No.: US 6,499,898 B1
(45) Date of Patent: Dec. 31, 2002

(54) ASSEMBLY FOR DISPENSING A PASTY PRODUCT OR A GEL

(76) Inventor: Firmin Garcia, 37, avenue Aristide Briand, 27000 Evreux (FR)

( * ) Notice: Subject to any disclaimer, the term of this patent is extended or adjusted under 35 U.S.C. 154(b) by 0 days.

(21) Appl. No.: 09/807,130

(22) PCT Filed: Oct. 9, 1998

(86) PCT No.: PCT/FR98/02165

§ 371 (c)(1),
(2), (4) Date: Jul. 12, 2001

(87) PCT Pub. No.: WO00/21685

PCT Pub. Date: Apr. 20, 2000

(51) Int. Cl.[7] ..... A45D 33/00

(52) U.S. Cl. ..... 401/130; 401/265; 401/266; 222/386; 222/383.3

(58) Field of Search ..... 222/260, 287, 222/383.3, 386; 401/147, 148, 150, 171, 176, 178, 205, 206, 130, 139, 261, 262, 265, 266

(56) References Cited

U.S. PATENT DOCUMENTS

| | | | | | |
|---|---|---|---|---|---|
| 4,652,163 | A | * | 3/1987 | Karliner et al. | 401/195 |
| 4,983,061 | A | * | 1/1991 | Demarest | 401/148 |
| 5,052,592 | A | * | 10/1991 | Wilken et al. | 222/212 |
| 5,937,865 | A | * | 8/1999 | Dhaliwal | 132/114 |

FOREIGN PATENT DOCUMENTS

| | | | |
|---|---|---|---|
| EP | 0 155 616 | A2 | 9/1985 |
| EP | 0 374 339 | Al | 6/1990 |
| EP | 0 380 183 | A1 | 8/1990 |
| EP | 0 506 564 | A1 | 9/1992 |
| EP | 0 720 953 | A1 | 2/1996 |
| WO | WO 99/15567 | A1 | 12/1990 |

* cited by examiner

*Primary Examiner*—Henry C. Yuen
*Assistant Examiner*—M A Cartagena
(74) *Attorney, Agent, or Firm*—Wood, Phillips, Katz, Clark & Mortimer

(57) ABSTRACT

An assembly is provided for dispensing a viscous fluid substance which can include a paste or a gel. The assembly includes a receptacle of variable volume containing the substance to be dispensed, and the dispensing is effected with an airless pump which comprises a pump body that communicates freely with the inside of the receptacle, and an outlet member through which the substance is discharged. The dispensing is effected with a dispensing head provided with dispensing channels which are open to the outside and which are fed via the outlet member of the pump. The assembly is characterized by the fact that the dispensing head comprises (1) a backplate which is provided with (a) an assembly system for assembling it onto the pump outlet member and (b) an opening facing the pump outlet member, and (2) an applicator element which is secured to the backplate, which is disposed on the other side of the backplate from the receptacle, and which is provided with openings that open towards the outside. The dispensing channels which connect the pump outlet member to the openings in the applicator element are disposed between the backplate and the applicator element.

12 Claims, 3 Drawing Sheets

ASSEMBLY FOR DISPENSING A PASTY PRODUCT OR A GEL

This application is an application filed under 35 U.S.C. Sec. 371 as a national stage of international application PCT/FR98/02165, which was filed Oct. 9, 1998.

TECHNICAL FIELD

BACKGROUND OF THE INVENTION

The present invention relates to an assembly for dispensing a semi-liquid substance or a gel.

The assembly of the invention is of the type including an airless pump. The receptacle containing the substance to be dispensed must therefore be of variable volume, i.e. its volume must be capable of decreasing as the substance is dispensed. In known manner, the variable-volume receptacle may be a rigid receptacle containing a follower piston that moves towards the pump as dispensing progresses, or a receptacle having a deformable wall made of a flexible plastics material or folded concertina-like. The pump is generally fixed to the pump body by being crimped onto a crimping dish or a plate. The pump includes a hollow projecting stem which serves both to actuate the pump and also to discharge the substance. The pump is actuated via a dispensing head by pushing in the projecting stem, the dispensing head containing dispensing channels that open out to the outside. That type of dispensing assembly is generally used for liquid or substances of little viscosity, and the substance is sprayed from the dispensing head.

For viscous substances, such as deodorants, an assembly is generally used in which the substance is in a receptacle provided with a follower piston, and in which the piston is pushed by means of a knurled wheel mechanism to discharge the substance. That system suffers from drawbacks:

firstly, the substance is not protected from ambient air during storage because, although the receptacle is closed with a lid, the lid is not airtight so that, in order to protect the substance during storage, it is necessary to put a protective film over the dispensing head; and secondly, applying the substance requires two successive actions: actuating the knurled wheel and applying the substance.

SUMMARY OF THE INVENTION

The present invention relates to a dispenser assembly which makes it possible to use a pump for dispensing a fluid substance that is relatively viscous, i.e. that is in the form of a paste or of a gel, and which offers the advantage of requiring only a single action in order both to dispense and to apply the substance.

In the invention, a receptacle of variable volume is used that is provided with a pump associated with a dispensing head, and that makes it possible, with a single action, both to actuate the pump and to apply the substance, the pressure exerted by the user on the dispensing head during application, e.g. as it rubs on the skin, actuating the pump and causing the substance to be dispensed.

The present invention provides an assembly for dispensing a viscous fluid substance, in particular a paste or a gel, said assembly including a receptacle of variable volume containing the substance to be dispensed, dispensing taking place by means of an airless pump which comprises a pump body that communicates freely with the inside of the receptacle, and an outlet member via which the substance is discharged, said dispensing being implemented by means of a dispensing head provided with dispensing channels which are open to the outside and which are fed via the outlet member of the pump, said assembly being characterized by the fact that the dispensing head comprises firstly a backplate which is provided with assembly means for assembling it onto the pump outlet member and with an opening facing said pump outlet member, and secondly an applicator element which is secured to the backplate, which is disposed on the other side of the backplate from the receptacle, and which is provided with openings opening towards the outside, the dispensing channels which connect the pump outlet member to the openings in the applicator element being disposed between the backplate and said applicator element.

Under these conditions, when the applicator element is pressed against the skin, the pump is simultaneously actuated because the applicator element and the backplate are secured together. The substance is discharged through the openings in the applicator element by means of the channels that connect the outlet member of the pump to the openings in applicator element. In the invention, the pressure exerted on the dispensing head during application is used to actuate the pump.

Advantageously, the pump is a pump having a projecting stem, said stem being hollow to constitute an outlet member through which the substance is discharged, and being capable of being pushed towards the pump body to dispense said substance.

In the invention, the dispensing channels may be provided in the backplate or in the support, or also in part in that surface of the backplate which faces towards the applicator element and in part in that surface of the applicator element which faces towards the backplate, the facing surfaces of the backplate and of the applicator being complementary and forming channels when they are disposed one against the other.

Preferably, the various channels connecting the pump outlet to the various openings of the applicator element have cross-sections that vary as a function of the lengths of the various channels, i.e. as a function of the relative disposition of the various openings and of the outlet of the pump, so as to obtain, for all of the openings in the applicator element, flow rates of substance to be dispensed that are substantially equal.

In the invention, the backplate is advantageously a plate that is generally plane or slightly convex. It is advantageously provided with an opening surrounded by a sleeve facing towards the receptacle, and serving to secure to the pump stem.

In a first embodiment of the invention, the applicator element includes a plate that is plane or slightly convex and that is provided with uniformly-distributed openings. During use, the user rubs the applicator against the skin, and, so doing, simultaneously actuates the pump and distributes the substance to be dispensed that is discharged via the openings provided in the plate.

In a second embodiment, the applicator element is provided with a trough whose end wall is provided with openings and whose side walls are fixed to at least one roller whose axis, embodied by a pin, is perpendicular to the axis of the receptacle, said roller being provided with radial blades, the axis of the roller being disposed so that the edges of the radial blades rub against the end wall of the trough and can take up the substance dispensed via the openings disposed in the end wall of the trough. The edges of each of the blades is preferably cut to a regular pattern, e.g. to a sinusoidal pattern.

In a third embodiment of the invention, the applicator element comprises a support provided with recesses in the form of spherical cups in which balls are disposed, openings being provided in the support at the bottoms of the recesses.

In a fourth embodiment of the invention, the applicator element comprises a comb made up of a base plate from which teeth project outwardly, each of the teeth being in the form of a prism of triangular or trapezium shaped right cross-section. Preferably, each of the teeth is formed of a prism having a cross-section that is isosceles trapezium shaped, and the edges of the teeth are disposed to be mutually parallel. The openings may be disposed in the base plate between the teeth but they preferably open out in the side walls of the teeth-forming prisms.

As indicated above, the backplate and applicator element assembly constitutes the system for actuating the pump. To this end, the assembly is fixed to the pump stem and it is suitable for being moved in linear translation when the user presses on the applicator element. The applicator element is generally provided with a skirt that is suitable for sliding on the side wall of the receptacle.

The pump used in the invention may be any airless pump. Preferably a "soft" pump is used that is actuated at a pressure less than 1 kilogram per square meter ($kg/m^2$).

Since the pump used in the dispenser assembly of the invention is airless, i.e. it has no air intake, the receptacle containing the substance to be dispensed is of variable volume, as explained above. It may be constituted by a bag having deformable walls which deform as the substance is dispensed, or by a receptacle with concertina-like folds that close up. Preferably, it is constituted by rigid casing in which a follower piston is mounted to slide in leaktight manner, which follower piston moves closer to the pump as the substance is dispensed. The end of the rigid casing may be open or it may be closed, an opening then being provided to enable air to enter.

The dispensing head of the assembly of the present invention is preferably covered with a cap.

In order for the invention to be better understood, a description follows by way of non-limiting example of embodiments shown in the accompanying drawings.

DETAILED DESCRIPTION OF THE PREFERRED EMBODIMENTS

Figure 1:
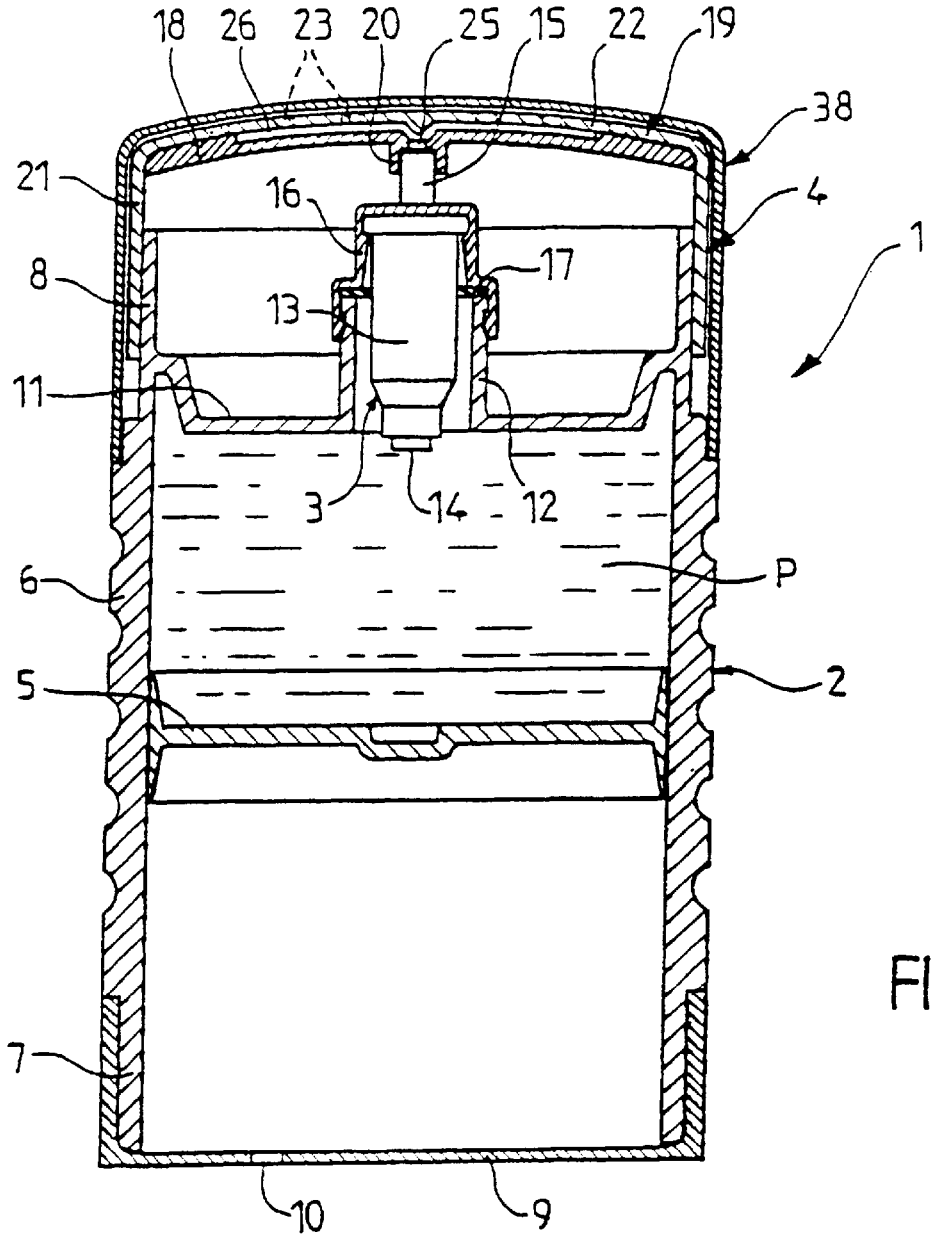
FIG. 1 is an axial section view of a first embodiment of he assembly of the invention.
Figure 2:
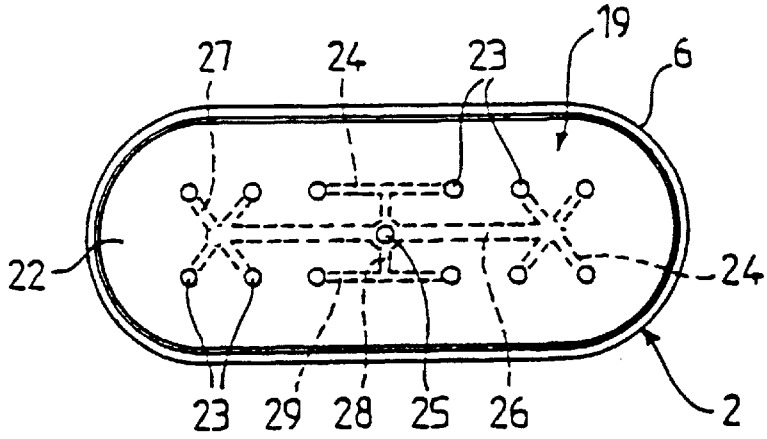
FIG. 2 is a plan view of the assembly shown in FIG. 1, after its protective cap has been removed.

The dispensing assembly shown in FIGS. 1 and 2 is designated by the overall reference 1. It is made up of a receptacle 2 which is equipped with a pump 3 and with a dispensing head 4, the dispensing head 4 being covered with a protective cap 38. The receptacle 2 is a receptacle which is made of a rigid material, in particular of a rigid plastics material, and in which a follower piston 5 is mounted to slide in leaktight manner. The receptacle 2 is made up of a side wall 6 defining a cylinder of oval cross-section, as shown in FIG. 2. At each of its bottom and top ends, the side wall 6 is provided with a rabbet whose back is formed by a portion of side wall of reduced thickness (respectively 7 and 8. The rabbet corresponding to the portion 7 makes it possible to engage the side wall 6 into a base 9 in the form of a dish whose end wall is provided with an opening 9 through which air can enter. Naturally, the base 9 may be omitted, because its function is essentially to improve appearance. The receptacle 2 is closed at its end opposite from the base 9 by a plate 11 which is molded integrally with the side wall 6 of the receptacle 2. The plate 11 is trough-shaped with its concave side facing towards the outside of the receptacle 2, and it carries an axial sleeve 12 open at both of its ends, and projecting towards the outside of the receptacle 2.

The pump 3 is pump of conventional type comprising a pump body 13 provided at its bottom (in FIG. 1) with an opening 14 putting the pump body 13 in communication with the substance P contained inside the receptacle 2 and, at its top (in FIG. 1), with a movably-mounted hollow stem 15 which, in known manner, serves both to move the piston of the pump in the pump body and as an outlet via which the substance to be dispensed is discharged. The pump body 13 is disposed inside the sleeve 12, and it is crimped thereon by means of a metal ring 16, a sealing gasket 17 being disposed between the top edge of the sleeve 12 and the metal crimping ring 16.

The dispensing head 4 is made up of a backplate 18 and of an applicator element 19, the backplate 18 being engaged into the applicator element 19 by force. In the embodiment shown in FIG. 1, the backplate 18 is in the form of a convex plate, its convex side facing towards the outside. An opening 25 is provided in the backplate 18. A sleeve 20 facing towards the inside of the assembly surrounds the opening 25 and projects from under the backplate. This sleeve 20 has an inside diameter that is equal to the outside diameter of the pump stem 15, ignoring the necessary clearance.

The applicator element 19 is made up of a side wall 21 and of an oval end wall 22 which is oval in cross-section, like the receptacle 2, and which has inside dimensions such that the inside surface of the side wall 21 is suitable for sliding in the rabbet corresponding to the reduced-thickness portion 8 of the side wall 6 of the receptacle 2. The backplate 18 is in abutment against the end wall 22 and has the same outline as said end wall.

The side wall 21 has a height such that, when the dispensing head 4 is fixed via the sleeve 20 to the pump stem 15, there remains some clearance between the bottom edge of the side wall 21 and the shoulder that limits the rabbet corresponding to the portion of reduced thickness 8, so as to enable the side wall 21 to slide in said rabbet when the stem 15 is pushed into the pump body 13.

Openings 23 are provided in the end wall 22. In the embodiment shown in FIG. 2, there are eight openings disposed symmetrically about the long axis of the end wall 22, the openings situated on the same side of the long axis being situated at a distance d apart from one another. The two symmetrical rows of openings 23 are also situated at the same distance d apart from each other.

Other configurations for the openings 23 are also possible, in particular as a function of the shape of the assembly 1. For example, the openings may be disposed on a circle, or on an ellipse, or they may be aligned.

In this embodiment, the set of dispensing channels 24 are constituted by grooves provided in the backplate 18, which grooves are closed by the applicator element 19 when the backplate 18 is pressed by being engaged by force against said applicator element 19. The various channels connect the opening 25 in the backplate 18 that corresponds to the sleeve 20 to the openings 23 in the applicator element 19. The pattern formed by the set of channels 24 is as shown in FIG. 2, i.e. it comprises an axial channel 26 extending along the long axis and intersecting the opening 25, which channel is connected at either end to channels 27 disposed in an X-shaped layout, the channel 26 opening out at the center of the X; a channel 28 intersecting the opening 25 is disposed along the short axis of the backplate 18, and it is connected to the middles of two symmetrical channels 29 that are parallel to the channel 26; the channels 29 interconnecting in pairs the four openings 23 that are closest to the opening 25. In cross-section, the channel 26 has dimensions that are larger than those of the other channels 27, 28, and 29. This configuration offers the advantage of enabling the substance that is to be dispensed to be dispensed uniformly.

FIGS. 3 to 10 shows three other embodiments of the dispensing head. The receptacle with which these dispensing heads are associated is identical to the receptacle shown in FIG. 1 and is therefore not shown.

Figure 3:
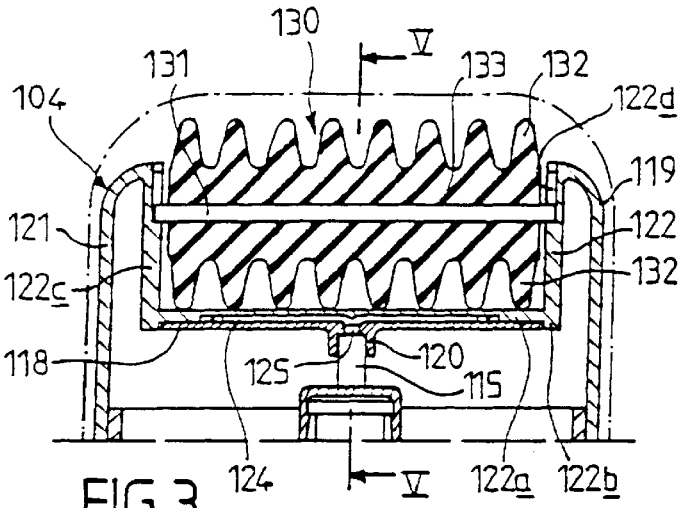
FIG. 3 is an axial section view of the dispensing head of a second embodiment of the assembly of the invention, on III—III of FIG. 5.
Figure 5:
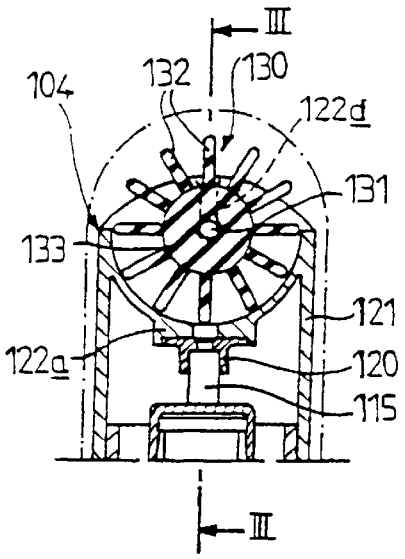
FIG. 5 is a section view on V—V of FIG. 3.
Figure 4:
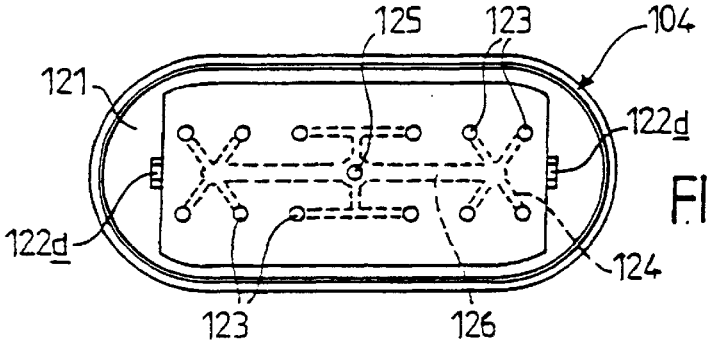
FIG. 4 is a plan view of the dispensing head of FIG. 3, after the roller has been removed.

In the embodiment shown in FIGS. 3 to 5, the dispensing head is designated by the overall reference 104. The dispensing head 104 comprises a backplate 118 and an applicator element 119. The backplate 118 is provided with an opening 125 surrounded by a sleeve 120 projecting towards the receptacle. The pump stem 115 is engaged into the sleeve 120. The applicator element 119 is provided with a skirt 121 suitable for sliding on the outside wall of the receptacle, as explained above with reference to FIG. 1. The skirt 121 is connected to a trough-shaped end wall 122 whose concave side faces upwards. The end wall 122*a* of the trough is in the form of a right cylinder sector. It engages onto the backplate 118 by means of a rim 122*b*. It is provided with openings 123 which are disposed as described above with reference to FIGS. 1 and 2. The channels 124 are also disposed in the same configuration as that described with reference to FIGS. 1 and 2. The inside surface of the side wall 122*c* of the trough is provided with two notches 122*d*. A roller 130 is fixed via a pin 131 embodying its axis in the two notches 122*d*. The roller 130 is provided with radial blades 132 extending radially outwards from a central cylindrical core 133. The edge of each of the blades 132 is cut to a sinusoidal pattern, as shown in FIG. 3.

The device operates as follows. When the user wishes to apply the substance to the skin, the user presses the dispensing head 104 against the skin, thereby pushing in the pump stem 115. The substance flows via the opening 125, via the channels 124, and via the openings 123. Since the user rolls the roller 130 over the skin, the roller turns, and the blades 132 then take up the substance that is discharged via the openings 123, and deposits it on the skin.

Figure 6:
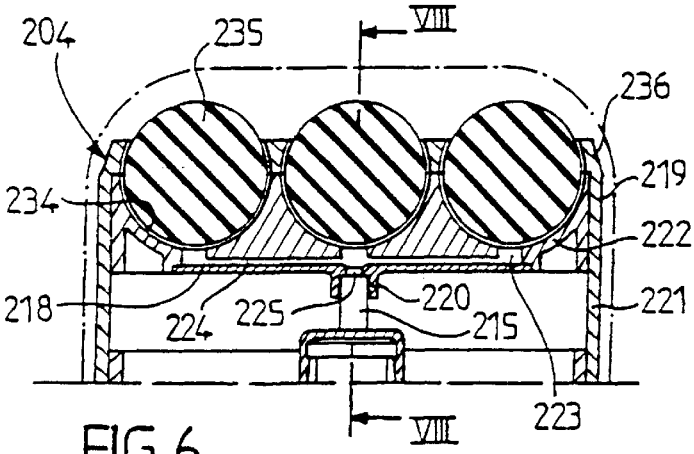
FIG. 6 is an axial section view of the dispensing head of a third embodiment of the assembly of the invention, on VI—VI of FIG. 8.
Figure 8:
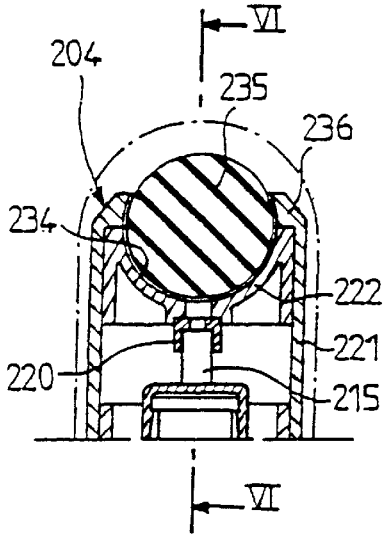
FIG. 8 is a section view on VIII—VIII of the assembly of FIG. 6.
Figure 7:
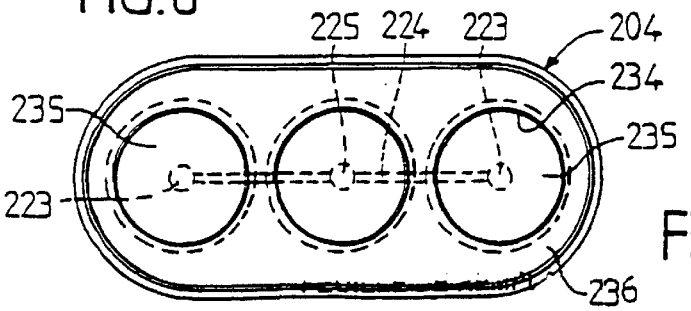
FIG. 7 is a plan view of the dispensing assembly of FIG. 6.

In the embodiment shown in FIGS. 6 to 8, the dispensing head is designated by overall reference 204. The dispensing head 204 includes a backplate 218 provided with an opening 225 surrounded by a sleeve 220 that engages onto the pump stem 215. The applicator element 219 onto which the backplate engages is made up of a support 22 provided with recesses 234 in the form of spherical cups containing balls 235. In the embodiment shown, there are three recesses and three balls, and their centers are aligned. The support 222 is engaged by force into a cylindrical skirt 221 whose top edge is curved inwards to form a collar 236. The bottom of each recess is provided with an opening 223. The channels 226 are constituted by grooves provided in the support 222, the grooves being closed by the backplate 218 when it is put in place. Since the openings 223 are aligned in the embodiment shown, there is a single rectilinear channel 224, as shown in FIG. 7.

In this embodiment, the dispensed substance is discharged via the openings 223 in the support 222. When they are applied against the skin, the balls turn and they deposit the substance on the skin.

Figure 9:
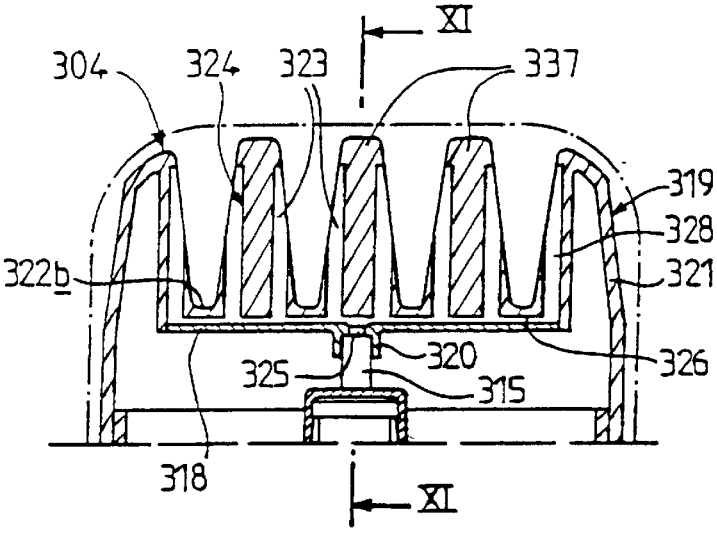
FIG. 9 is an axial section view of a fourth embodiment of the assembly of the invention, on IX—IX of FIG. 11.
Figure 11:
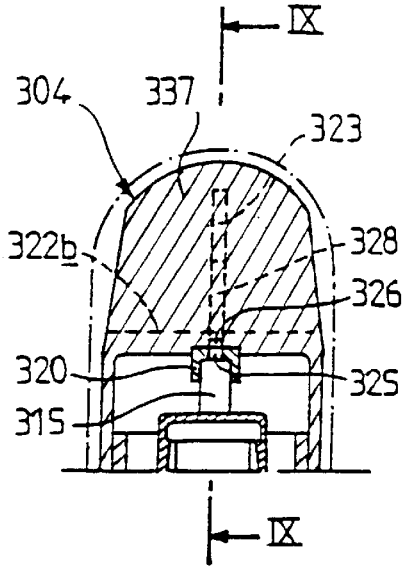
FIG. 11 is a second view on XI—XI of the assembly of FIG. 9.
Figure 10:
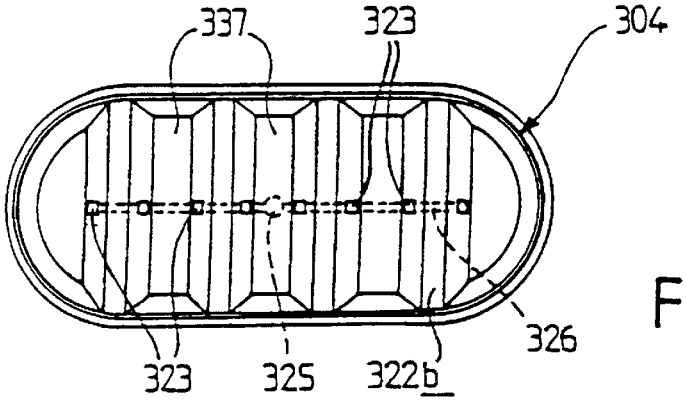
FIG. 10 is a plan view of the assembly of FIG. 9.

In the embodiment shown in FIGS. 9 to 11, the dispensing head is designated by overall reference 304. This dispensing head 304 is constituted by a backplate 318 and by an applicator element 319. The backplate 318 is provided with an opening 325 and with a sleeve 320 which engages onto the pump stem 315. The applicator element 319 is provided with a cylindrical skirt 321 suitable for sliding on the receptacle and that defines a trough. The end wall of the trough is formed by a plane surface 322*b* from which parallel prismatic teeth 337 project, the right section of each tooth being isosceles trapezium shaped. The backplate 318 is fixed to the plane surface 322*b* of the applicator element 319. The teeth 337 are provided with vertical channels 328 that open out in the faces of the teeth to constitute openings 323. Between the backplate 318 and the surface 322*b*, a channel 326 is provided half in the backplate 318 and half in the surface 322*b* of the applicator element. The channels 323 open out in the channel 326, thereby together constituting the channels 324 that connect the opening 325 in the backplate to the openings 223 in the applicator element. Operation is analogous to the operation described for the embodiment of FIG. 1.

What is claimed is:

1. An assembly (1) for dispensing a viscous fluid substance (P), in particular a paste or a gel, said assembly including a receptacle (2) of variable volume containing the substance (P) to be dispensed, dispensing taking place by means of an airless pump (3) which comprises a pump body (13) that communicates freely with the inside of the receptacle (2), and an outlet member (15, 115, 215, 315) via which the substance is discharged, said dispensing being implemented by means of a dispensing head (4, 104, 204, 304) provided with dispensing channels (24, 124, 224, 324) which are open to the outside and which are fed via the outlet member of the pump (3), the dispensing head (4, 104, 204, 304) comprising firstly a backplate (18, 118, 218, 318) which is provided with assembly means (20, 120, 220, 320) for assembling it onto the pump outlet member (15, 115, 215, 315) and with an opening (25, 125, 225, 325) facing said pump outlet member, and secondly an applicator element (19, 119, 219, 319) which is secured to the backplate (18, 118, 218, 318), which is disposed on the other side of the backplate from the receptacle (2), and which is provided with openings (23, 123, 223, 233) opening towards the outside, each dispensing channel (24, 124, 224, 324) connecting the pump outlet member (15, 115, 215, 315) to a respective opening (23, 123, 223, 323) in the applicator element (19, 119, 219, 319), the dispensing channels being disposed between the backplate (18, 118, 218, 318) and said applicator element (19, 119, 219, 319).

2. An assembly according to claim 1, characterized by the fact that the pump (3) is a pump having a projecting stem (15, 115, 215, 315), said stem being hollow to constitute an outlet member through which the substance (P) is discharged and being capable of being pushed towards the pump body (13) to dispense said substance (P).

3. An assembly according to claim 2, said assembly being characterized by the fact that the backplate (18, 118, 218, 318) is provided with an opening (25, 125, 225, 325) surrounded by a sleeve (20, 120, 220, 320) facing towards the receptacle (2), said sleeve fitting onto the free end of the pump stem (15, 115, 215, 315).

4. An assembly according to claim 1, characterized by the fact that the dispensing channels (24) are provided in the applicator element (18).

5. An assembly according to claim 1, characterized by the fact that the dispensing channels (124, 224) are provided in the applicator element (119, 219).

6. An assembly according to claim 1, characterized by the fact that the dispensing channels (324) are provided in part in that surface of the backplate (318) which faces towards the applicator element (219) and in part in that surface of the applicator element (319) which faces towards the backplate (318), the facing surfaces of the backplate (318) and of the applicator (319) being complementary and forming channels (324) when they are disposed one against the other.

7. An assembly according to claim 1, characterized by the fact that the various channels connecting the pump outlet member (15, 115, 215, 315) to the various openings (23, 123, 223, 323) of the applicator element (19, 119, 219, 319) have cross-sections that vary as a function of the distance from the openings to the pump outlet member so as to obtain, for all of the openings (23, 123, 223, 323) in the applicator element (19, 119, 219, 319), flow rates of substance to be dispensed (P) that are substantially equal.

8. An assembly according to claim 1, characterized by the fact that the applicator element (19) constitutes a backplate (22) that is plane or slightly convex and that is provided with uniformly-distributed openings (23).

9. An assembly according to of claim 1, characterized by the fact that the applicator element (119) is provided with a trough (122) whose end wall (122*a*) is provided with openings (123) and whose side walls (122*c*) are fixed to at least one roller (130) whose axis, embodied by a pin (131), is perpendicular to the axis of the receptacle (2), said roller being provided with radial blades (132).

10. An assembly according to of claim 1, characterized by the fact that the applicator element (219) includes a support (222) provided with recesses (234) in the form of spherical cups in which balls (235) are disposed, openings (223) being provided in the support (222) at the bottoms of the recesses (234).

11. An assembly according to of claim 1, characterized by the fact that the applicator element (319) comprises a comb (322) made up of a base plate (322*b*) from which parallel prismatic teeth (337) project outwardly, each of the teeth having a right cross-section that is isosceles trapezium shaped, the openings (323) opening out in the side walls of the prisms that form the teeth (337).

12. An assembly according to of claim 1, characterized by the fact that the applicator element (19, 119, 219, 319) is provided with a skirt (21, 121, 221, 321) that is suitable for sliding on the side wall of the receptacle (2).

* * * * *